US008736181B2

(12) United States Patent
Lee et al.

(10) Patent No.: US 8,736,181 B2
(45) Date of Patent: May 27, 2014

(54) AC DRIVEN LIGHT EMITTING DEVICE

(75) Inventors: Young Jin Lee, Seoul (KR); Hyung Kun Kim, Gyunggi-do (KR); Kyung Mi Moon, Gyunggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 157 days.

(21) Appl. No.: 13/215,619

(22) Filed: Aug. 23, 2011

(65) Prior Publication Data

US 2012/0043896 A1 Feb. 23, 2012

(30) Foreign Application Priority Data

Aug. 23, 2010 (KR) ..... 10-2010-0081616

(51) Int. Cl.
*H05B 37/02* (2006.01)

(52) U.S. Cl.
USPC ..... 315/185 R; 315/193; 315/307

(58) Field of Classification Search
USPC ..... 315/185 R, 193, 192, 246, 250, 291, 315/307, 308
See application file for complete search history.

(56) References Cited

U.S. PATENT DOCUMENTS

2008/0211421 A1 9/2008 Lee et al.
2009/0167202 A1* 7/2009 Miskin et al. ..... 315/250
2010/0072898 A1 3/2010 Ohashi et al.
2010/0181930 A1* 7/2010 Hopwood et al. ..... 315/297
2010/0277084 A1* 11/2010 Lee et al. ..... 315/192
2011/0199007 A1* 8/2011 Yang ..... 315/185 R

FOREIGN PATENT DOCUMENTS

CN 201550329 U 8/2010
JP 2008-103470 A 5/2008
KR 10-2007-0000654 A 1/2007
KR 10-2008-0088825 A 10/2008

OTHER PUBLICATIONS

Chinese Office Action with English translation issued in Chinese Application No. 201110242079.5 dated Aug. 29, 2013.

* cited by examiner

*Primary Examiner* — David H Vu
(74) *Attorney, Agent, or Firm* — McDermott Will & Emery LLP

(57) ABSTRACT

There is provided an alternating current (AC) driven light emitting device including a plurality of LED arrays connected in series, each having a structure in which a plurality of LEDs are electrically connected to form a two-terminal circuit and emit light by a bidirectional voltage when an AC voltage is applied to the two-terminal circuit; and a switching device connected to at least one of the plurality of LED arrays and controlling a total driving voltage with respect to the plurality of LED arrays. The AC driven light emitting device permits operation from a low driving voltage Vf while having a high driving voltage at a high voltage Vf, thereby achieving excellence in terms of power factor, THD, and energy efficiency.

8 Claims, 9 Drawing Sheets

AC DRIVEN LIGHT EMITTING DEVICE

CROSS-REFERENCE TO RELATED APPLICATIONS

This application claims the priority of Korean Patent Application No. 10-2010-0081616 filed on Aug. 23, 2010, in the Korean Intellectual Property Office, the disclosure of which is incorporated herein by reference.

BACKGROUND OF THE INVENTION

1. Field of the Invention

The present invention relates to an alternating current (AC) driven light emitting device.

2. Description of the Related Art

Semiconductor light emitting diodes (LEDs) have advantages as light sources in terms of output, efficiency, and reliability. Research into the development of semiconductor LEDs that are able to replace the backlights of lighting apparatuses or display devices as high-output and high-efficiency light sources have been actively conducted.

In general, LEDs are driven at a low DC voltage. Therefore, an additional circuit (e.g., an AC/DC converter) that supplies a low DC output voltage is required to drive a light emitting diode at a normal voltage (e.g., AC 220V). However, the introduction of the additional circuit may not only complicate the configuration of an LED module, but also reduce the efficiency and reliability thereof during a process of converting supply power. Further, an additional component in addition to a light source increases manufacturing costs and product size, and electro-magnetic interference (EMI) characteristics are deteriorated due to periodic components during a switching-mode operation.

In order to solve these problems, various types of LED driving circuits that can be driven at an AC voltage without using an additional converter have been proposed. However, due to the diode characteristics of the LED, it is difficult to achieve bidirectional AC driving with the use of only the LED. A Zener diode may protect the LED, but it is inefficient in terms of size, capacity and cost. Unidirectional 60 Hz driving deteriorates flicker characteristics so that the quality of light may be problematic. Also, in the case of the use of high-voltage AC power, there is a limitation in achieving efficient driving with the use of a single LED that commonly has a driving voltage Vf of 3V to 4V. Therefore, a high-voltage LED, permitting bidirectional operation at 120 Hz and having a high driving voltage Vf, is required to design an AC driven light emitting device.

SUMMARY OF THE INVENTION

An aspect of the present invention provides an alternating current (AC) driven light emitting device having a high driving voltage Vf at a high voltage while permitting operation from a low driving voltage Vf, thereby achieving excellence in terms of power factor, total harmonic distortion (THD), and energy efficiency.

According to an aspect of the present invention, there is provided an AC driven light emitting device including: a plurality of LED arrays connected in series, each having a structure in which a plurality of LEDs are electrically connected to form a two-terminal circuit and emit light by a bidirectional voltage when an AC voltage is applied to the two-terminal circuit; and a switching device connected to at least one of the plurality of LED arrays and controlling a total driving voltage with respect to the plurality of LED arrays.

The switching device may be connected to both terminals of a circuit configured by the at least one of the plurality of LED arrays.

The switching device may be selected from the group consisting of a resistor, a current regulative diode and a switch.

The switching device may cause the at least one of the plurality of LED arrays connected thereto to operate in order of non-emitting, emitting, and non-emitting with respect to a half-cycle of the AC voltage.

The switching device may cause the at least one of the plurality of LED arrays connected thereto to emit light at a peak voltage of the AC voltage.

A power factor of the AC driven light emitting device may be 0.9 or greater.

A total harmonic distortion (THD) of the AC driven light emitting device may be 30% or greater.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
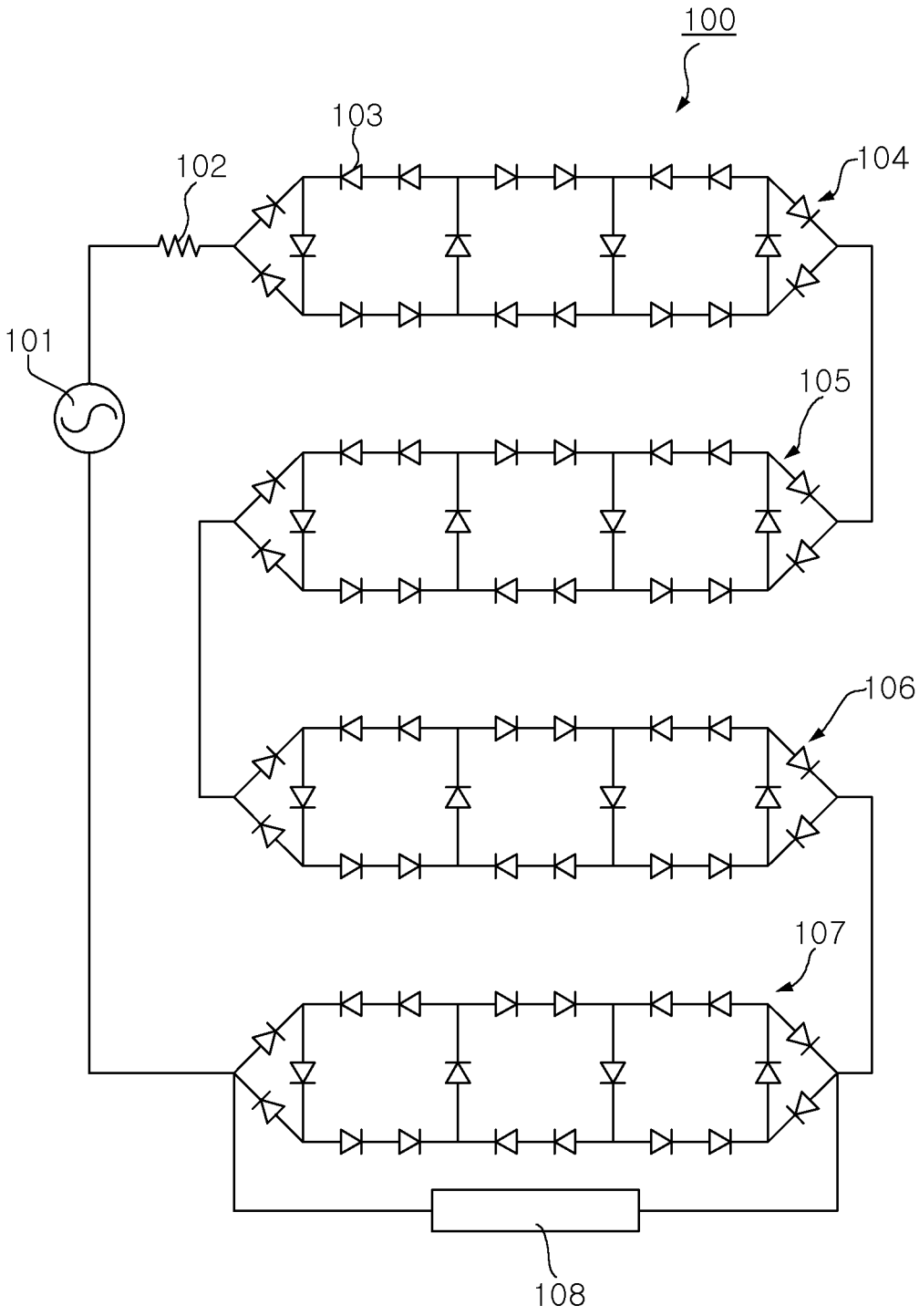
FIG. 1 is an equivalent circuit diagram of an alternating current (AC) driven light emitting device connected to an AC power source according to an exemplary embodiment of the present invention.

Exemplary embodiments of the present invention will now be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions may be exaggerated for clarity, and the same reference numerals will be used throughout to designate the same or like elements.

FIG. 1 illustrates an equivalent circuit diagram of an alternating current (AC) driven light emitting device connected to an AC power source according to an exemplary embodiment of the present invention. An AC driven light emitting device 100 according to the present embodiment of the invention includes a plurality of LED arrays 104 to 107, each having a plurality of LEDs 103 connected to one another. Each of the LED arrays 104 to 107 forms a two-terminal circuit. When AC power from an AC power source 101 is applied to the two-terminal circuit, the LEDs 103 are connected to emit light by bidirectional voltage. Also, as shown in FIG. 1, the LED arrays 104 to 107 are electrically connected to one another in series and each of the LED arrays 104 to 107 can be driven with AC voltage, and thus the AC driven light emitting device 100 having such a series-connection configuration is also operable with AC voltage. In the present embodiment, the four LED arrays 104 to 107 are employed. However, the number of LED arrays may be appropriately changed according to the magnitude of AC voltage or LED driving voltage.

Figure 2:
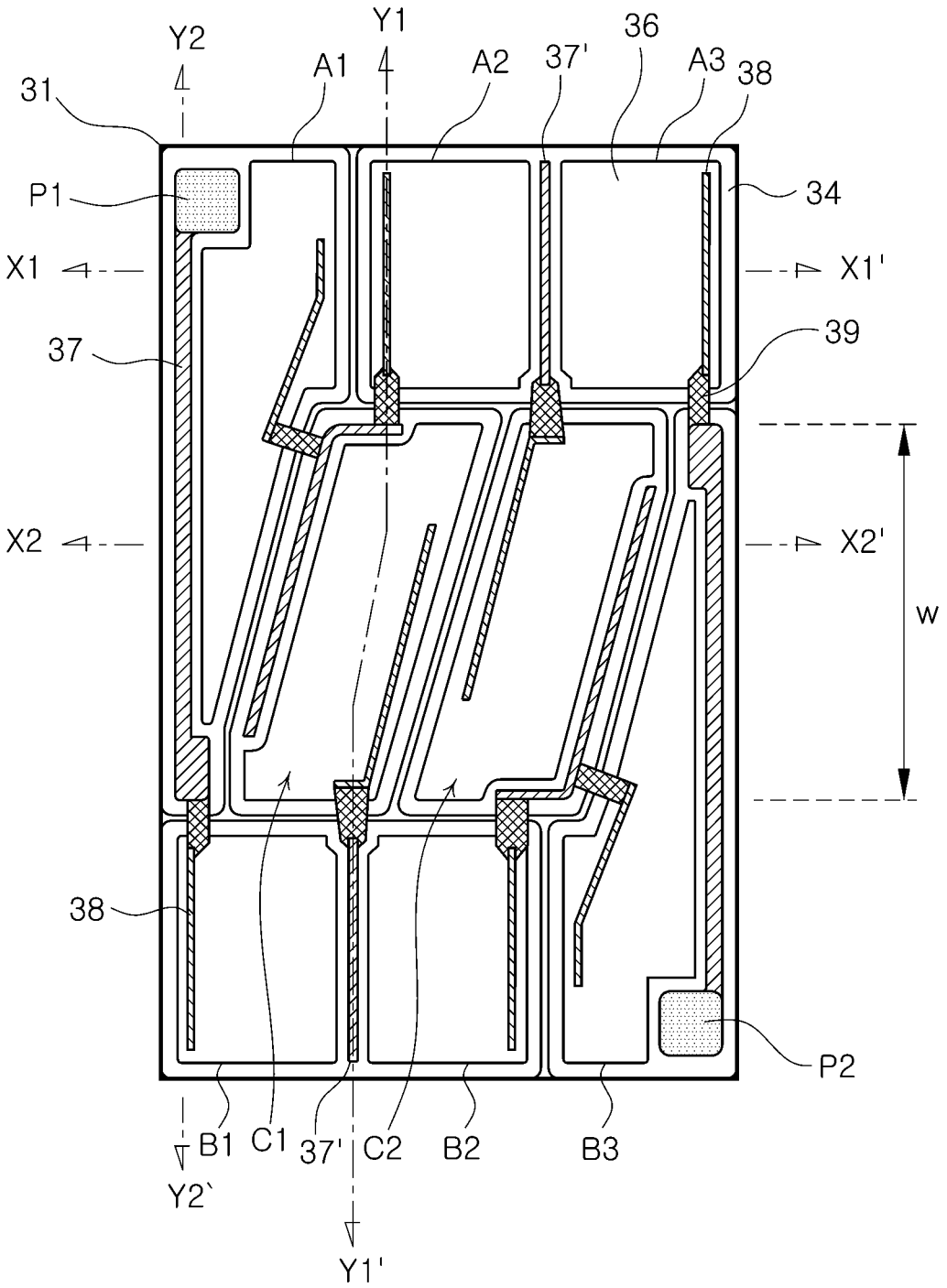
FIG. 2 is a plan view illustrating an example of an LED array applicable to the light emitting device of FIG. 1.
Figure 3:
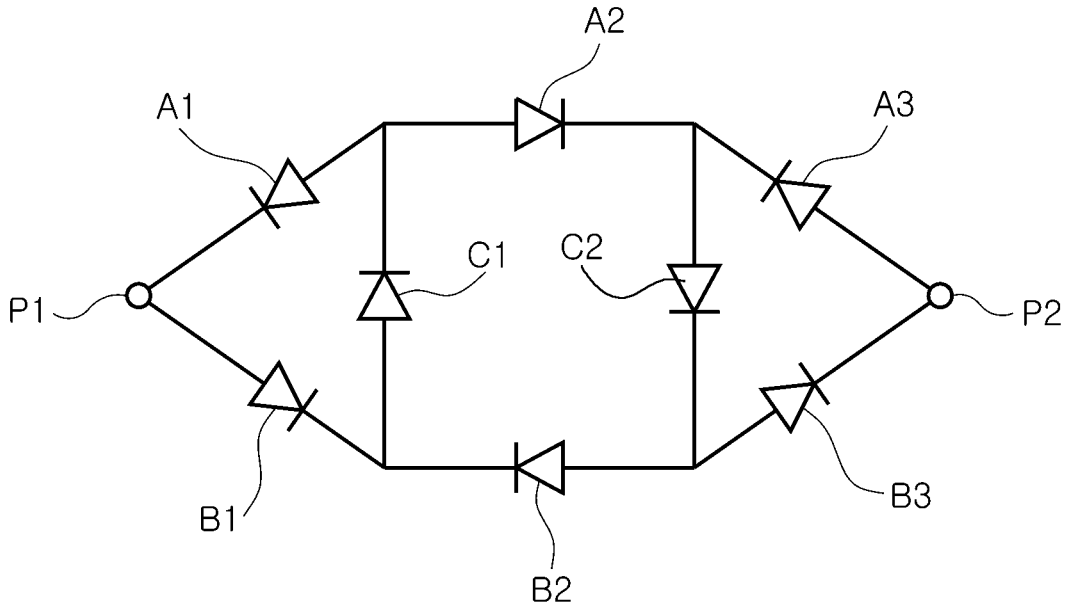
FIG. 3 is an equivalent circuit diagram of the LED array of FIG. 2.

According to the present embodiment, each of the LED arrays 104 to 107 has a ladder circuit structure, as shown in FIG. 1, so as to enable AC driving even without an AC/DC converter or the like. FIG. 2 is a plan view illustrating an example of an LED array applicable to the light emitting device of FIG. 1. In this case, for the convenience of explanation, FIG. 2 shows an LED array having eight LEDs, unlike that of FIG. 1. It can be understood that the number of LEDs in the circuit diagram of FIG. 1 decreases from four LEDs to two LEDs in a ladder part and from two LEDs to one LED at a node connected to the ladder part (see an equivalent circuit diagram illustrated in FIG. 3).

The LED array, shown in FIG. 2, can be driven by the AC power as described above, and includes a substrate 31 having a rectangular shape with four sides, i.e., first to fourth sides e1 to e4. Three first LED cells A1, A2 and A3 are arrayed in a row along the first side e1 on a top surface of the substrate 31. Three second LED cells B1, B2 and B3 are arrayed in a row along the second side e2 facing the first side e1. Two third LED cells C1 and C2 are arrayed between the rows of the first and second LED cells. As such, the first to third LED cells form a single LED array structure.

In the first to third LED cells employed in the present embodiment, a first electrode 37 or 37' and a second electrode 38 are respectively disposed adjacent to opposite sides of a top surface of a corresponding one of the LED cells. Also, the first and second electrodes 37, 37' and 38 each have a portion extending along the corresponding side adjacent thereto. Since the first and second electrodes 37, 37' and 38 respectively extend along both opposite sides, uniform current distribution may be obtained over the entire light emitting area of each LED cell. As a result, light emitting efficiency may be enhanced.

As described in the present embodiment, the primary first LED cell A1 may extend up to the primary second LED cell B1 along the third side e3 of the top surface of the substrate 31. Also, the tertiary second LED cell B3 may extend up to the tertiary first LED cell A3 along the fourth side e4 of the top surface of the substrate 31. In this manner, the sizes and shapes of the LED cells are adjusted to thereby achieve the higher degree of integration. The LED array may have a first external electrode P1 and a second external electrode P2. The first external electrode P1 is connected to the first electrode of the primary first LED cell A1 and the second electrode of the primary second LED cell B1. The second external electrode P2 is connected to the second electrode of the tertiary first LED cell A3 and the first electrode of the tertiary second LED cell B3. As shown in FIG. 2, the first external electrode P1 may be placed on the primary first LED cell A1, and the second external electrode P2 may be placed on the tertiary second LED cell B3. Since the extended LED cells A1 and B3 are advantageous in design so as to have wider light emitting areas relative to the other LED cells, areas for the external electrodes may be easily ensured in the extended LED cells.

FIGS. 4A through 4D are side sectional views illustrating the LED array of FIG. 2.

The first to third LED cells of the LED array according to the present embodiment may be obtained from a first conductivity type semiconductor layer 34, an active layer 35, and a second conductivity type semiconductor layer 36 sequentially grown on the substrate 31. That is, the first conductivity type semiconductor layer 34, the active layer 35, and the second conductivity type semiconductor layer 36 are grown on the entirety of the top surface of the substrate 31 for a light emitting structure. Thereafter, a resulting structure is isolated in units of cells using a proper isolation process, and thus the arrangement of the plurality of first to third LED cells illustrated in FIG. 2 may be achieved.

Figure 4A:
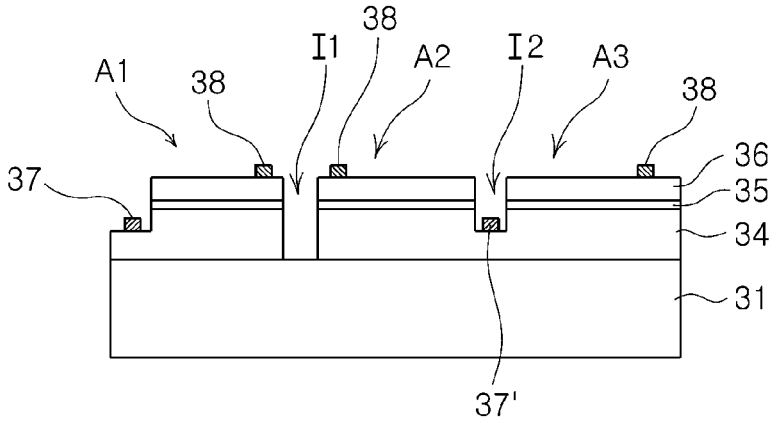
FIGS. 4A through 4D are side sectional views of the LED array of FIG. 2.

FIG. 4A is a cross-sectional view of the LED array of FIG. 2, taken along line X1-X1'. With reference to FIG. 4A, the primary first LED cell A1 and the secondary first LED cell A2 are isolated from each other by a full-isolation process I1 for exposing a region of the substrate 31, whereas the secondary first LED cell A2 and the tertiary first LED cell A3 may be isolated by a half-isolation process I2 for exposing a region of the first conductivity type semiconductor layer 34. The secondary first LED cell A2 and the tertiary first LED cell A3 may share the first electrode 37' formed on the exposed region of the first conductivity type semiconductor layer 34. The half-isolation process is partially performed within a range permitting the implementation of a desired LED driving circuit, and the first electrode 37' is formed on the exposed region of the first conductivity type semiconductor layer 34 to be shared by adjacent cells, so that the process may be simplified and the degree of integration may be improved.

Figure 4B:
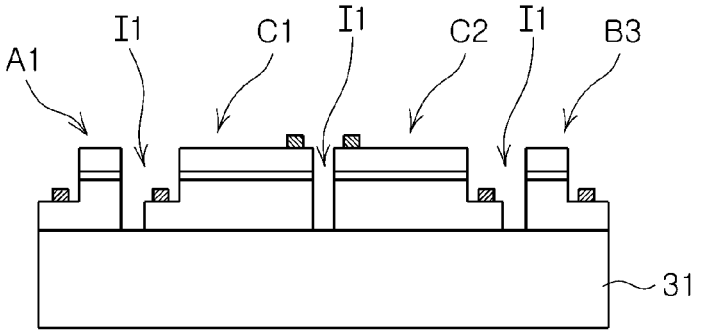
Figure 4C:
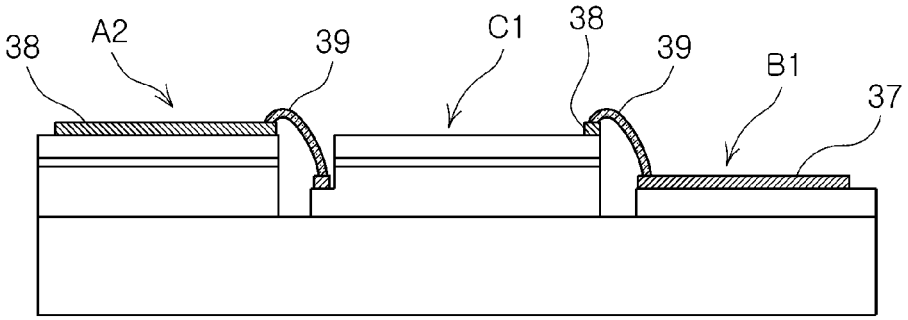

FIG. 4B is a cross-sectional view of the LED array of FIG. 2, taken along line X2-X2'. As shown in FIG. 4B, the primary first LED cell A1 and the tertiary second LED cell B3 are isolated from the third LED cells C1 and C2 by the full-isolation process I1, and the second LED cells B1 and B2 are isolated from each other by the full-isolation process I1. FIG. 4C is a cross-sectional view of the LED array of FIG. 2, taken along line Y1-Y1'. As shown in FIG. 4C, the first LED cell A1, the second LED cell B3 and the third LED cell C1 are isolated from each other by the full-isolation process I1. Wiring 39 between the electrodes of the individual cells may be configured by air bridges or wires as described above.

Figure 4D:
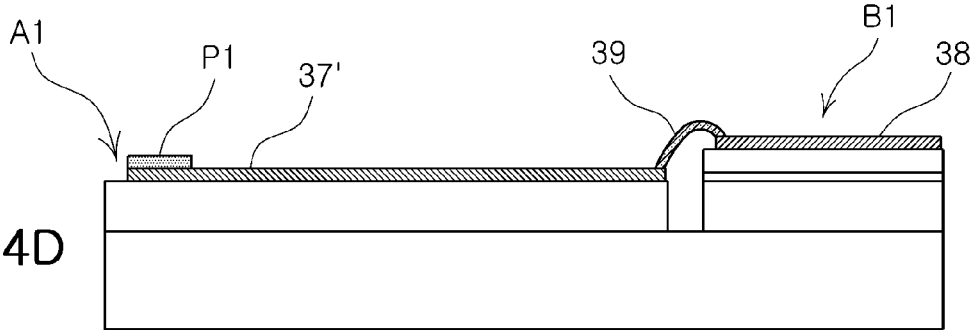

FIG. 4D is a cross-sectional view of the LED array of FIG. 2, taken along line Y2-Y2'. As shown in FIG. 4D, the primary first LED cell A1 and the primary second LED cell B1 are isolated from each other by the full-isolation process I1. The isolation and connection of the tertiary first and second LED cells A3 and B3 may be understood in a similar manner.

Unlike in the case of the present embodiment, all the first to third LED cells may be isolated from other adjacent LED cells by exposing regions of the substrate 31, i.e., by the full-isolation process. Each cell may have individual first and second electrodes without the sharing thereof.

Figure 5:
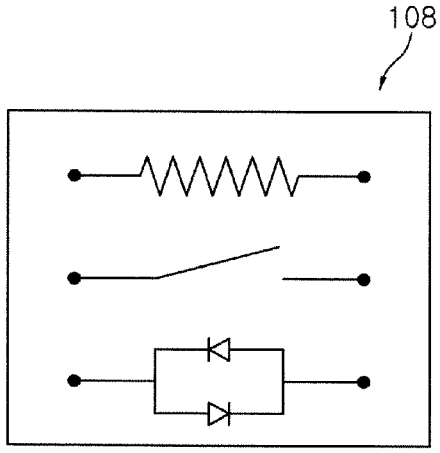
FIG. 5 illustrates examples of the switching device of FIG. 1.

With reference to FIG. 1, operations of the AC driven light emitting device 100 will be described. As described above, both terminals of a circuit configured by at least one of the plurality of series-connected LED arrays 104 to 107 may be connected to a switching device 108. In the present embodiment, both terminals of the fourth LED array 107 are connected to the switching device 108. The switching device 108 controls the LED array 107 connected thereto to emit light or not, i.e., to be in an emitting state or non-emitting state. In order to enable this, the switching device 108 adjusts the current flowing into the LED array 107. FIG. 5 shows examples of the switching device of FIG. 1. As shown in FIG. 5, the switching device 108 performing the above-described functions may be a resistor, a switch, a current regulative diode, or the like. In the case in which a resistor or a current regulative diode is employed as the switching device 108, the number of driven LED arrays may be adjusted according to the magnitude of voltage applied to an AC driven circuit even without the inclusion of a separate control system, so that the circuit structure may be simplified.

Figure 6:
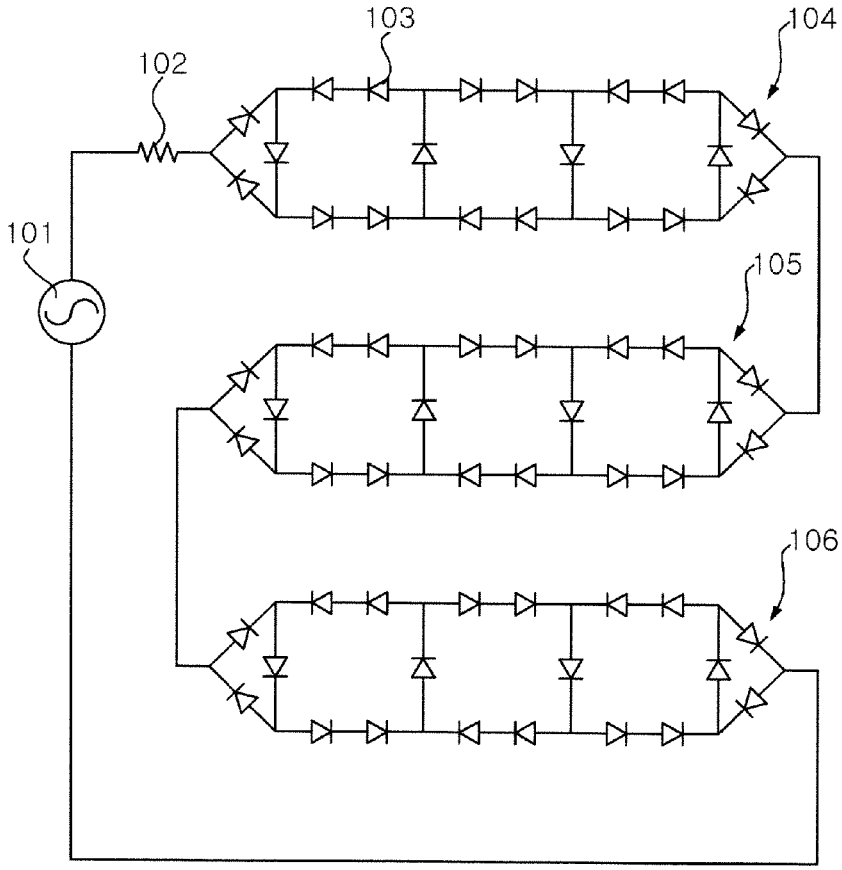
FIG. 6 illustrates an example of driving the AC driven light emitting device of FIG. 1.
Figure 7:
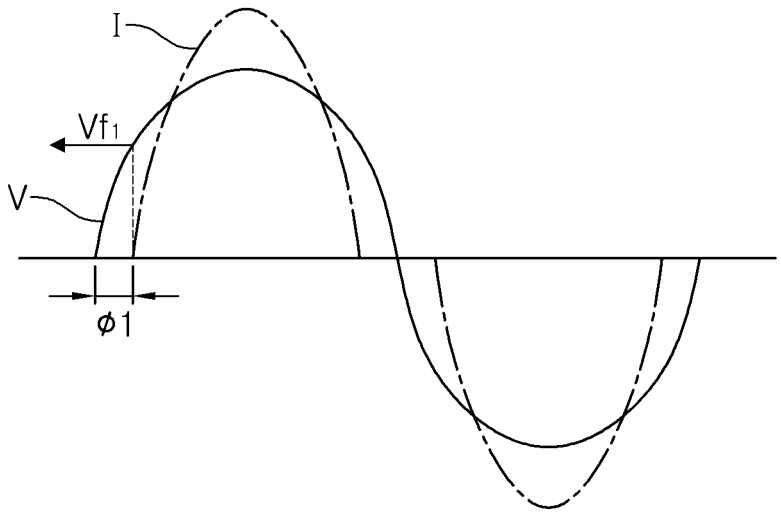
FIG. 7 illustrates voltage and current waveforms according to the driving example of FIG. 6.

The switching device 108 employed in the present embodiment, when receiving AC voltage from the AC power source 101, serves to adjust the number of the LEDs 103 emitting light in the AC driven light emitting device 100. With reference to FIGS. 6 through 9, when a relatively low voltage is applied thereto, current flows through the switching device 108, and accordingly, as shown in FIG. 6, the number of LED arrays emitting light in the AC driven light emitting device 100 is three, i.e., the LED arrays 104 to 106. Since the LED arrays 104 to 106, among all the LED arrays 104 to 107, emit light, as shown in the graph of FIG. 7, a total driving voltage Vf1 of the AC driven light emitting device 100 has a relatively low level, a phase difference $\phi_1$ between voltage V and current I is also small. FIG. 7 illustrates voltage and current waveforms in the AC driven light emitting device of FIG. 6. Due to this reduced driving voltage, a power factor and a total harmonic distortion (THD) may be improved, and since the driving time of LEDs with respect to one cycle of the AC voltage is extended, flicker characteristics may also be improved.

Figure 8:
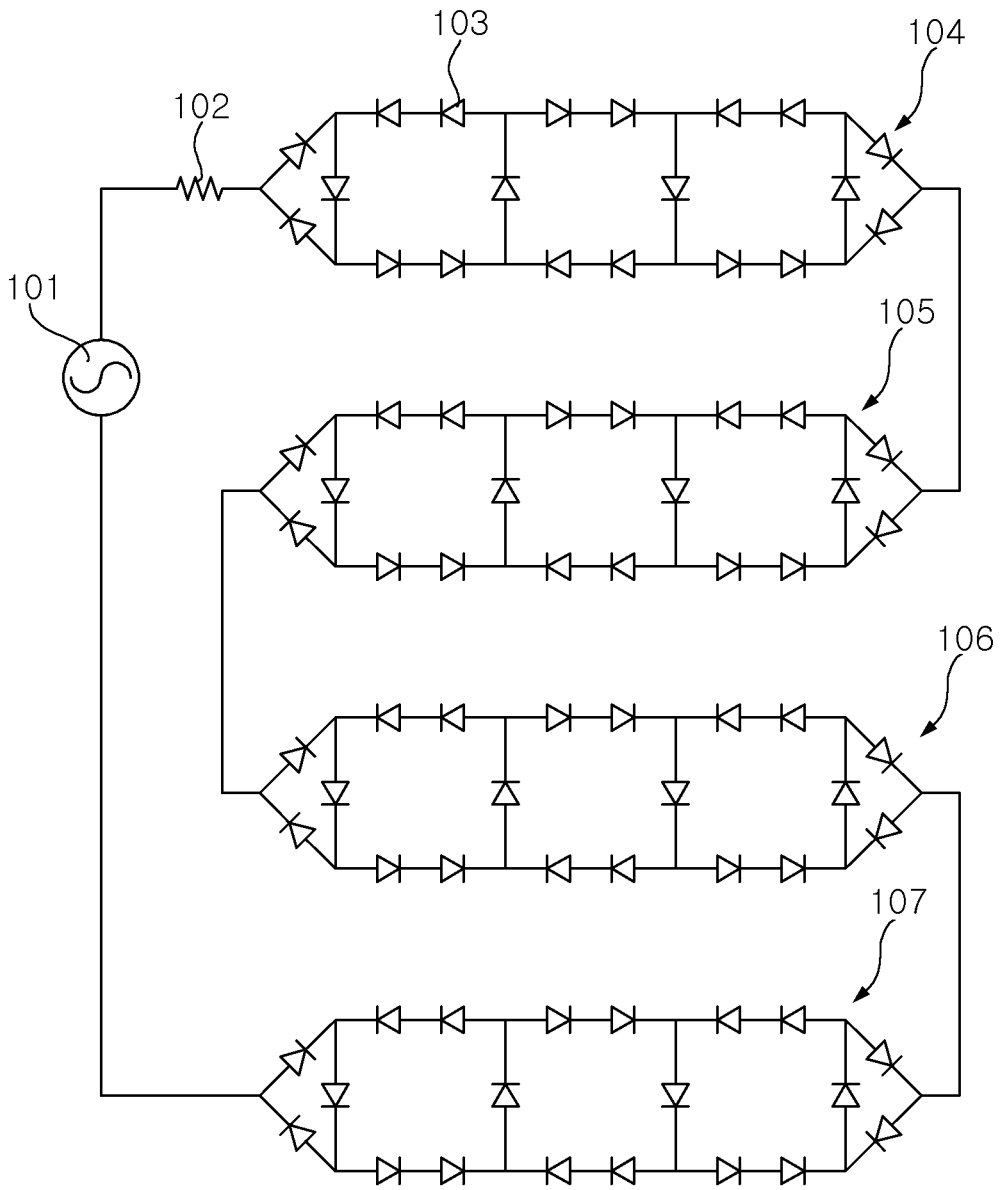
FIG. 8 illustrates another example of driving the AC driven light emitting device of FIG. 1.
Figure 9:
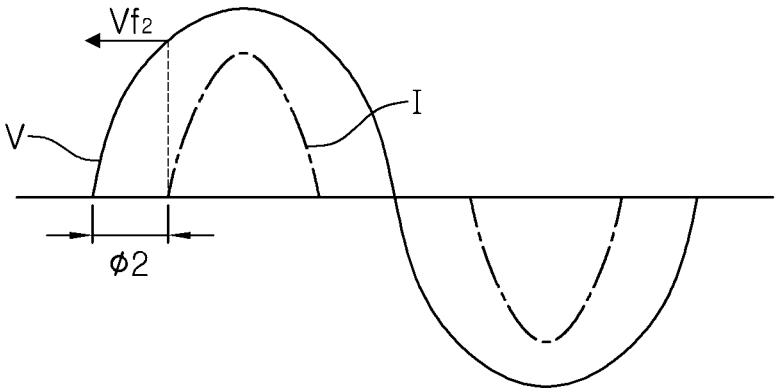
FIG. 9 illustrates voltage and current waveforms according to the driving example of FIG. 8.

However, in the case in which the driving voltage Vf1 is low, an excessively high voltage is applied to the LEDs when a high voltage is applied thereto, and thus requiring an external resistor (102 of FIG. 1) having relatively high resistance. Accordingly, power consumption in the resistor is increased to thereby deteriorate energy efficiency. In order to minimize this problem, the present embodiment employs the switching device 108 to increase the number of the LEDs 103 emitting light during the operation of the AC driven light emitting device 100. That is, the switching device 108 is turned off around the peaks of the AC voltage V, and accordingly, the current is applied to the LED array 107. Specifically, as shown in FIG. 8, the four LED arrays 104 to 107 of the AC driven light emitting device 100 emit light. As the number of LEDs emitting light increases, a total driving voltage Vf2 and a phase difference $\phi_2$ also increase as shown in FIG. 9. FIG. 9 illustrates voltage and current waveforms in the AC driven light emitting device of FIG. 8.

Figure 10:
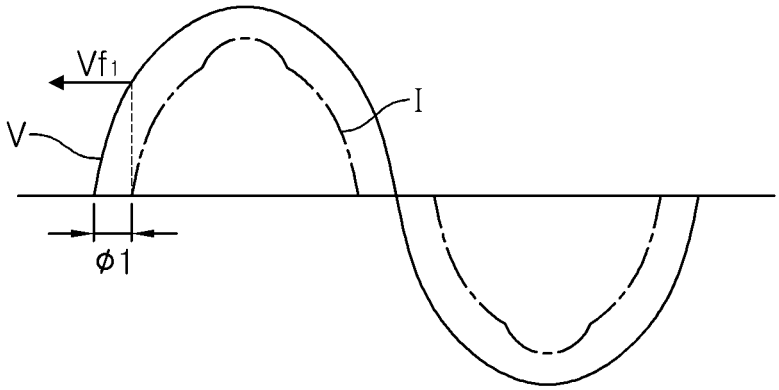
FIG. 10 illustrates current and voltage waveforms when the switching device of FIG. 1 is employed.

In contrast with FIG. 6, in the case in which the driving voltage Vf2 increases, power consumption in the resistor 102 is reduced, and thus energy efficiency is enhanced. However, the power factor and THD characteristics are deteriorated. In the present embodiment, the number of the LEDs 103 emitting light is appropriately changed according to the magnitude of the driving voltage so that power factor, THD, and flicker characteristics as well as energy efficiency are all enhanced. Specifically, the switching device 108 serves to allow the AC driven light emitting device 100 to be initially driven with a low driving voltage to thereby enhance the power factor characteristics, and to have a high driving voltage around the peaks of the AC voltage. Thereafter, the switching device 108 allows the AC driven light emitting device 100 to have a low driving voltage. That is, the LED array 107 connected to the switching device 108 is controlled to operate in the order of non-emitting, emitting, and non-emitting with respect to a half-cycle of the AC voltage. In this case, the switching device 108 may control two or more LED arrays according to necessity. FIG. 10 illustrates current and voltage waveforms when the switching device according to the present embodiment is employed. In the AC driven light emitting device 100 employing such a circuit structure, a power factor of 0.9 or greater, a THD of 30% or greater, and an energy efficiency of 75% or greater were obtained.

Figure 11:
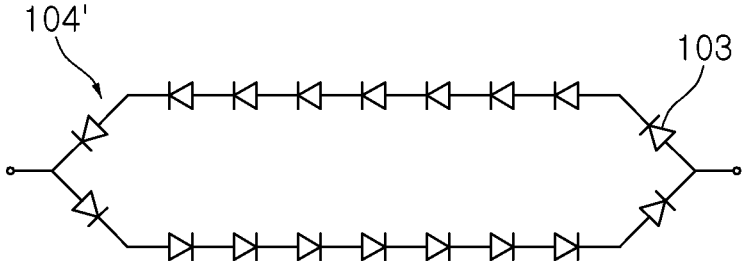
FIGS. 11 and 12 are equivalent circuit diagrams illustrating alternatives to the LED array of the exemplary embodiment depicted in FIG. 1.
Figure 12:
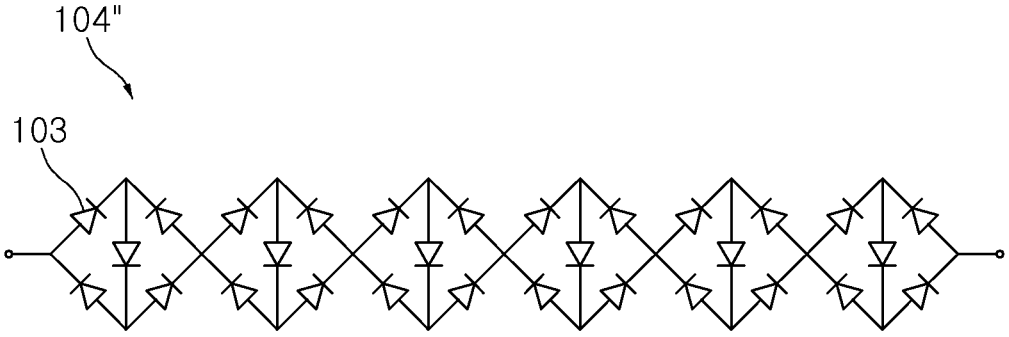

Meanwhile, FIGS. 11 and 12 are equivalent circuit diagrams illustrating alternatives to the LED array of the exemplary embodiment depicted in FIG. 1. The number of ladder parts and LEDs connected between individual nodes in the ladder circuit of the exemplary embodiment of FIG. 1 may be appropriately changed. Further, another circuit enabling AC driving, i.e., an LED array 104' of FIG. 11, configured as a reverse-parallel circuit, or an LED array 104" of FIG. 12, configured as a bridge circuit, may be also applicable to the AC driven light emitting device 100 of FIG. 1.

As set forth above, an AC driven light emitting device according to exemplary embodiments of the invention has a high driving voltage at a high voltage Vf while permitting operation from a low driving voltage Vf, thereby achieving excellence in terms of power factor, THD, and energy efficiency.

While the present invention has been shown and described in connection with the exemplary embodiments, it will be apparent to those skilled in the art that modifications and variations can be made thereto without departing from the spirit and scope of the invention as defined by the appended claims.

What is claimed is:

1. An alternating current (AC) driven light emitting device, comprising:

a plurality of LED arrays connected in series, each having a structure in which a plurality of LEDs are electrically connected to form a two-terminal circuit and emit light by a bidirectional voltage when an AC voltage is applied to the two-terminal circuit; and a switching device connected to at least one of the plurality of LED arrays and controlling a total driving voltage with respect to the plurality of LED arrays, wherein at least one of the plurality of LEDs in each LED array is configured to maintain an emitting state during a full-cycle of the AC voltage.

2. The AC driven light emitting device of claim 1, wherein the switching device is connected to both terminals of a circuit configured by the at least one of the plurality of LED arrays.

3. The AC driven light emitting device of claim 1, wherein the switching device is selected from the group consisting of a resistor, a current regulative diode and a switch.

4. The AC driven light emitting device of claim 1, wherein the switching device causes the at least one of the plurality of LED arrays connected thereto to operate in order of non-emitting, emitting, and non-emitting with respect to a half-cycle of the AC voltage.

5. The AC driven light emitting device of claim 4, wherein the switching device causes the at least one of the plurality of LED arrays connected thereto to emit light at a peak voltage of the AC voltage.

6. The AC driven light emitting device of claim 1, wherein a power factor of the AC driven light emitting device is 0.9 or greater.

7. The AC driven light emitting device of claim 1, wherein a total harmonic distortion (THD) of the AC driven light emitting device is 30% or greater.

8. The AC driven light emitting device of claim 1, wherein the switching device and the at least one of the plurality of LED arrays are connected in parallel.

* * * * *